United States Patent [19]

Allan et al.

[11] 4,137,149

[45] Jan. 30, 1979

[54] SLURRY HYDROGEN TREATING PROCESSES

[75] Inventors: David E. Allan; William E. Lewis; William J. Metrailer, all of Baton Rouge, La.

[73] Assignee: Exxon Research & Engineering Co., Florham Park, N.J.

[21] Appl. No.: 810,913

[22] Filed: Jun. 29, 1977

[51] Int. Cl.[2] ..... C10G 13/18; C10G 23/10

[52] U.S. Cl. ..... 208/93; 208/100; 208/108; 208/157; 208/264

[58] Field of Search ..... 208/92, 100, 157, 93, 208/143, 108, 95

[56] References Cited

U.S. PATENT DOCUMENTS

| | | | |
|---|---|---|---|
| 2,469,332 | 5/1949 | Evans | 208/92 |
| 2,844,524 | 7/1958 | Ernst | 208/92 |
| 2,873,247 | 2/1959 | Borey | 208/100 |
| 3,151,060 | 9/1964 | Garbo | 208/143 |
| 3,412,010 | 11/1968 | Alpert et al. | 208/143 |
| 3,761,393 | 9/1973 | Wolk et al. | 208/157 |
| 3,844,937 | 10/1974 | Wolk | 208/95 |
| 3,932,269 | 1/1976 | Lehman | 208/157 |
| 4,040,943 | 8/1977 | Stolfa | 208/95 |

*Primary Examiner*—Herbert Levine
*Attorney, Agent, or Firm*—Marthe L. Gibbons

[57] ABSTRACT

The liquid product of a slurry hydrogen treating zone is separated into fractions in the same separation zone used to obtain the heavy hydrocarbonaceous oil fraction used as feed for the hydrogen treating zone. A separate portion of coarser solids is withdrawn from the hydrogen treating zone.

11 Claims, 1 Drawing Figure

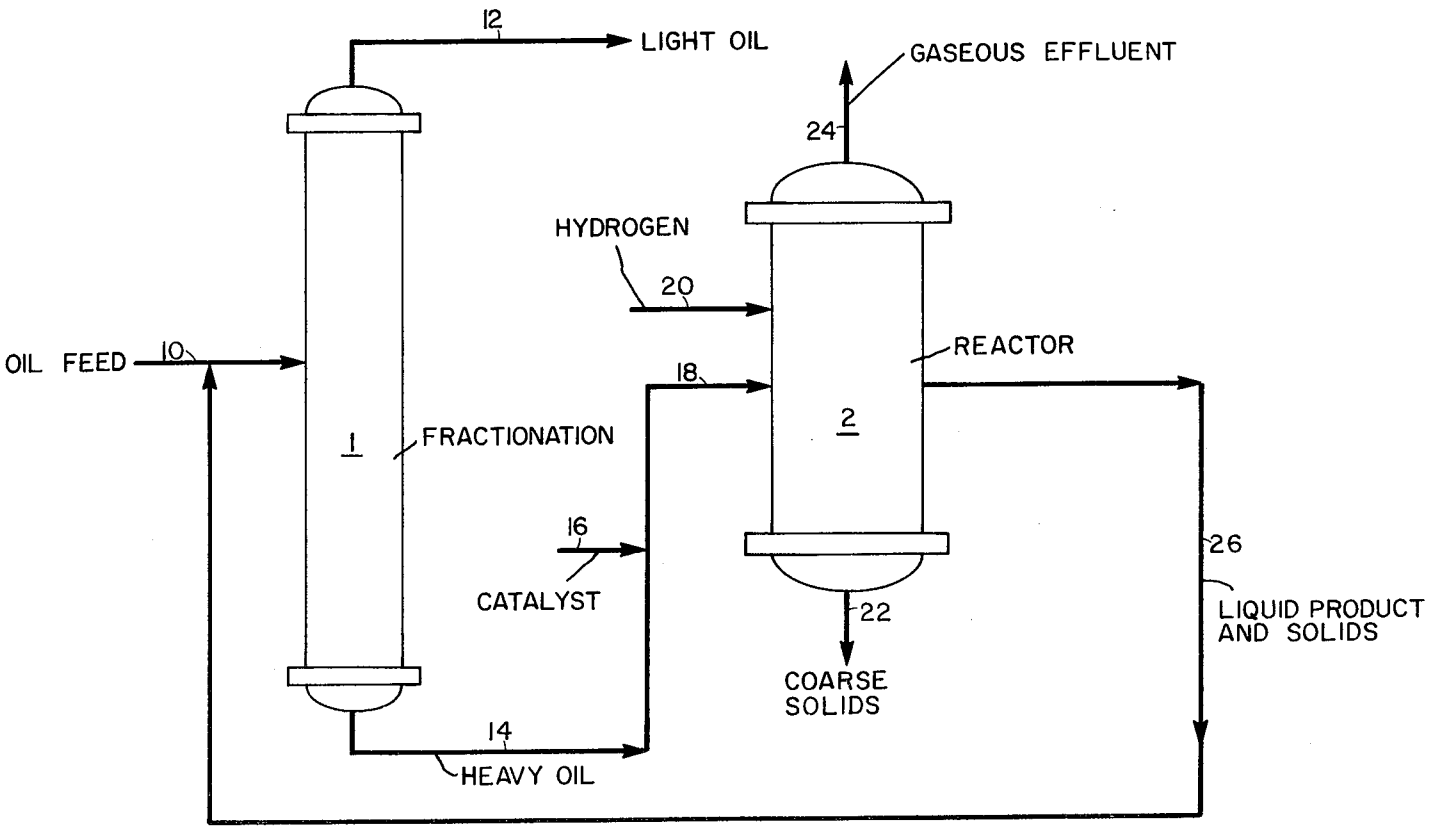
OIL FEED
10
1
FRACTIONATION
12
LIGHT OIL
HYDROGEN
20
18
16
CATALYST
14
HEAVY OIL
2
REACTOR
24
GASEOUS EFFLUENT
22
COARSE SOLIDS
26
LIQUID PRODUCT AND SOLIDS

SLURRY HYDROGEN TREATING PROCESSES

BACKGROUND OF THE INVENTION

1. Field of the Invention

This invention relates to an improvement in a slurry type of hydrogen treatment of a heavy hydrocarbonaceous oil. It particularly relates to the hydrorefining or hydroconversion of a heavy hydrocarbonaceous oil comprising a catalyst dispersed in the oil.

2. Description of the Prior Art

Hydrorefining processes utilizing dispersed catalysts in admixture with the hydrocarbonaceous oil are well known.

U.S. Pat. No. 3,161,585 discloses a hydrorefining process in which a petroleum oil chargestock containing a colloidally dispersed catalyst selected from the group consisting of Groups VB and VIB, an oxide of said metal and a sulfide of said metal is reacted with hydrogen at hydrorefining conditions.

It is also known to use finely divided Group VIII metal components in a catalytic slurry process for the hydrogenative conversion of heavy oils. See, for example, U.S. Pat. Nos. 1,876,270; 2,091,831; 3,617,503; 3,297,563 and 3,622,498.

It is known to separate in the same still a hydrocarbonaceous feed and reaction products of a hydrocarbon conversion process (see, for example, U.S. Pat. No. 2,773,017).

It is also known to recycle a slurry of oil and solids from a fractionator to a reactor (see, for example, U.S. Pat. No. 2,464,810).

U.S. Pat. No. 3,297,563 discloses a slurry hydrotreating process in which a bleed stream of slurry is removed from the hydrotreating reactor.

In the slurry type of hydrorefining or hydroconversion process utilizing heavy oil feeds, the effluent of the reaction zone contains catalytic solids in the liquid product. Regardless of the method of concentrating the solids, the liquid product, for example, of a hydroconversion zone, will generally be separated into normally liquid lighter boiling converted material and higher boiling unconverted material. The conventional practice is to utilize a first pipestill to separate a hydrocarbonaceous oil into fractions, at least one of which will be used as feed for the hydrogen treating zone, and subsequently, passing the liquid product effluent of the hydrogen treating zone with or without solids to a second pipestill to separate the liquid product into fractions.

It has now been found that the second pipestill can be omitted by recycling the liquid product of the hydrogen treating zone to the pipestill used to obtain the oil feed for the hydrogen treating zone. Furthermore, the coarser solids are removed from the reactor to obtain a purge of solids from the system.

SUMMARY OF THE INVENTION

In accordance with the invention there is provided, in a slurry hydrogen treating process wherein a hydrocarbonaceous oil is separated into fractions, including a heavy oil fraction, in a separation zone, and wherein a slurry of said oil and added particulate catalytic solids or precursors of particulate catalytic solids is hydrogen treated at hydrogen treating conditions, in the presence of hydrogen and the resulting hydrogen treated effluent comprising a normally liquid product comprising a lighter oil, a heavy oil and solids, is removed from the hydrogen treating zone, the improvement which comprises (a) passing at least a portion of said liquid product, without intervening distillation, to said separation zone, said portion of liquid product comprising solids and at least a portion of said light oil and at least a portion of said heavy oil; (b) separating said portion of liquid product in combination with said hydrocarbonaceous oil in said separation zone to produce said fractions, and (c) removing a separate portion of said solids from said hydrogen treating zone.

BRIEF DESCRIPTION OF THE DRAWING

The Figure is a schematic flow plan of one embodiment of the invention.

DESCRIPTION OF THE PREFERRED EMBODIMENT

A preferred embodiment will be described with reference to the accompanying figure. Referring to the figure, a hydrocarbonaceous oil is passed by line 10 into a separation zone such as a pipestill 1 wherein the oil is fractionally distilled together with a recycle stream to be described later. The pipestill may be an atmospheric pipestill or a vacuum pipestill. When an atmospheric distillation is conducted in an atmospheric pressure pipestill, the hydrocarbonaceous oil separated therein will usually be a heavy crude petroleum oil. Other suitable hydrocarbonaceous feed for the atmospheric pipestill include oil derived from tar sands, oil derived from shale, oil derived from the liquefaction of coal and mixtures thereof. When the vacuum distillation is conducted in a vacuum pipestill, the feed to the vacuum pipestill will generally be an atmospheric residuum, that is, a residuum resulting from an atmospheric pressure distillation stage. Preferably, the hydrocarbonaceous oil feed will be separated by means of a vacuum distillation in a vacuum pipestill. The pipestill is operated in a conventional way. An oil fraction boiling, at atmospheric pressure, below about 1050° F. is removed from the pipestill by line 12. If desired, this fraction may be further processed, for example, hydrodesulfurized in a conventional way. A stream of heavy oil having an atmospheric pressure boiling point above about 1050° F. is removed from pipestill 1 by line 14. At the start of the process, particulate catalytic solids and/or precursors of particulate catalytic solids are introduced into the heavy oil stream by line 16. Any suitable catalyst or catalyst precursor that will produce a desired hydrogen refining or hydrogen conversion of the heavy oil can be used. The catalyst may, for example, be a Group VB or a Group VIB or a Group VIII metal, metal oxide, or metal sulfide or mixtures thereof. After the process is in operation, it may only be necessary to introduce small additional makeup amounts of catalysts by line 16 since the stream carried in line 14 will contain recycled catalytic solids, as will hereinafter be described in more detail. The slurry of heavy oil containing catalytic solids is passed by line 18 into a hydrogen treating zone in reactor 2. The slurry of heavy oil may suitably comprise from about 1 to about 15 weight percent solids. Hydrogen is introduced into reactor 2 by line 20. The hydrogen treating zone can be operated at known hydrorefining conditions to achieve predominantly desulfurization and demetallization of the feed with mild hydroconversion by maintaining the hydrorefining zone at a temperature ranging from about 650 to 750° F. and at a hydrogen partial pressure ranging from about 500 to about 1500 psig, whereby at least a portion of the sulfur in the feed is converted to hydrogen sulfide.

Alternatively, the hydrogen treating zone can be operated at predominantly hydroconversion conditions by maintaining the reaction zone at a temperature ranging from above about 750 to 1000° F. with a hydrogen partial pressure ranging from about 500 to 5000 psig, preferably from about 1500 to about 3000 psig, whereby the oil feed is converted to lower boiling products such as light petroleum gases, naphtha, middle distillate, etc. by cracking and reaction with hydrogen.

The term "hydroconversion" is used herein to designate a process conducted in the presence of hydrogen in which at least a portion of the heavy constituents and coke precursors (as measured by Conradson carbon residue) of the heavy hydrocarbonaceous oil is converted to lower boiling hydrocarbon products while simultaneously reducing the concentration of nitrogenous compounds, sulfur compounds, and metallic contaminants.

During the hydrorefining or hydroconversion reaction, a small amount of solid carbonaceous material (coke) is formed, with associates itself with the catalytic solid particles. A settling zone is provided in the bottom portion of reactor 2 so that the coarser coked solids can settle and be continuously or intermittently purged from reactor 2 by line 22. Generally, the solids present in the heavy oil undergoing hydrogen treatment in reactor 2 will have a particle size ranging from about 1 to about 100 microns in diameter. Particles having a diameter greater than 50 microns will settle in the settling zone and be removed from the process. The purge rate can be adjusted to provide the proper take off rate so that there is no undue buildup of coked solids in the process. The stream removed by line 22 generally comprises a small amount of oil as well as the coarser solids. Since the settled particles have a diameter greater than 50 microns, the coarse particles can be separated from the oil by conventional means. It desired, the oil separated from the coarse solids may be recycled to line 10.

A gaseous effluent comprising hydrogen and normally gaseous hydrocarbons is removed from reactor 2 by line 24. This gas may be further separated by conventional means, if desired, to remove a portion of the gaseous hydrocarbons as is well known in the art. The hydrogen-rich gas may be recycled to the hydrotreating zone. Generally, contaminants, such as $H_2S$, are removed from the hydrogen-rich gas prior to recycle. The normally liquid product is removed from reactor 2 by line 26. This liquid product comprises a light oil, a heavier oil and the smaller particle size solids, that is, solids smaller than 50 microns in diameter. Instead of passing the normally liquid product to a separate distillation zone, this stream is passed, without intervening distillation, by line 26 to pipestill 1 to be separated with the oil feed. If desired, prior to passing this stream to pipestill 1, lighter boiling material may be separated therefrom, for example, in a vacuum preflash.

Therefore, this eliminates the need to send the liquid product of the reactor to a separate second distillation zone to separate the liquid product into a lighter oil and heavier oil. Instead, the liquid product, by being sent to the pipestill of the hydrocarbonaceous oil feed, is separated simultaneously with the feed.

Furthermore, when the recycled liquid product comprises catalytic solids, passage through the pipestill provides dispersion of the solids in the oil so that the slurry removed from the pipestill for subsequent hydrogen treatment is a well mixed slurry of heavy oil and catalyst.

What is claimed is:

1. In a slurry hydrogen treating process wherein a hydrocarbonaceous oil is separated into fractions, including a heavy oil fraction, in a separation zone, and wherein a slurry of said heavy oil and particulate solids is hydrogen treated in a hydrogen treating zone at hydrogen treating conditions, in the presence of hydrogen and the resulting normally liquid product comprising a lighter oil, a heavier oil and solids is removed from the hydrogen treating zone, the improvement which comprises:

(a) passing at least a portion of said liquid product, without intervening distillation, to said separation zone, said portion of liquid product comprising at least a portion of said light oil, at least a portion of said heavy oil and solids having a particle size up to about 50 microns in diameter, (b) separating said portion of liquid product with said hydrocarbonaceous oil in said separation zone to produce said fractions, and (c) removing a separate portion of solids from said hydrogen treating zone, the solids of said separate portion of solids having a particle size greater than 50 microns in diameter.

2. The process of claim 1 wherein said separate portion of said solids comprises coarser particles of the solids of said hydrogen treating zone.

3. The process of claim 1 wherein said hydrocarbonaceous oil is a crude petroleum oil.

4. The process of claim 1 wherein said heavy oil is an atmospheric residuum.

5. The process of claim 1 wherein said hydrocarbonaceous oil is separated by atmospheric distillation.

6. The process of claim 1 wherein said hydrocarbonaceous oil is separated by a vacuum distillation.

7. The process of claim 1 wherein said slurry of heavy oil and solids subjected to hydrogen treating conditions comprises from about 1 to about 15 weight percent solids.

8. The process of claim 1 wherein said hydrogen treating zone is operated at hydrorefining conditions and wherein said hydrorefining conditions include a temperature ranging from about 650 to about 750° F. and a pressure ranging from about 500 to about 1500 psig.

9. The process of claim 1 wherein said hydrogen treating zone is operated at hydroconversion conditions and wherein said hydroconversion conditions include a temperature ranging from above about 750 to about 1000° F. and a pressure ranging from about 500 to about 5000 psig.

10. The process of claim 1 wherein a gaseous effluent is removed from said hydrogen treating zone, said gaseous effluent comprising hydrogen and normally gaseous hydrocarbons.

11. The process of claim 10 wherein at least a portion of said gaseous effluent is recycled to said hydrogen treating zone.

* * * * *